United States Patent [19]

McDugle et al.

[11] Patent Number: 4,981,781

[45] Date of Patent: Jan. 1, 1991

[54] PHOTOGRAPHIC EMULSIONS CONTAINING INTERNALLY MODIFIED SILVER HALIDE GRAINS

[75] Inventors: Woodrow G. McDugle; John E. Keevert, both of Rochester; Alfred P. Marchetti, Penfield, all of N.Y.

[73] Assignee: Eastman Kodak Company, Rochester, N.Y.

[21] Appl. No.: 406,208

[22] Filed: Aug. 28, 1989

[51] Int. Cl.[5] ..... G03C 1/06

[52] U.S. Cl. ..... 430/605; 430/567; 430/569; 430/596; 430/604; 430/612

[58] Field of Search ..... 430/567, 569, 596, 604, 430/605, 612

[56] References Cited

U.S. PATENT DOCUMENTS

| | | | |
|---|---|---|---|
| 2,448,060 | 8/1948 | Trivelli and Smith | 95/7 |
| 2,717,833 | 9/1955 | Wark | 430/604 |
| 3,790,390 | 2/1974 | Shiba et al. | 96/125 |
| 3,890,154 | 5/1975 | Ohkubo et al. | 96/125 |
| 4,126,472 | 11/1978 | Sakai et al. | 96/110 |
| 4,147,542 | 4/1979 | Habu et al. | 96/27 E |
| 4,828,962 | 5/1989 | Grzeskowiak et al. | 430/612 |
| 4,835,093 | 5/1989 | Janusonis et al. | 430/567 |
| 4,847,191 | 7/1989 | Grzeskowiak | 430/605 |

FOREIGN PATENT DOCUMENTS

| | | | |
|---|---|---|---|
| 0242190 | 10/1987 | European Pat. Off. . | |
| 2332 | 10/1980 | PCT Int'l Appl. | 430/612 |
| 665515 | 1/1952 | United Kingdom | 430/612 |

OTHER PUBLICATIONS

Definition of Terms: *Chemical and Engineering News,* Feb. 4, 1985, p. 26.

*Research Disclosure,* vol. 176, Dec. 1978, Item 17643, Section IA, and Section IIIA.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978.

At the 1982 International Congress of Photographic Science at the University of Cambridge, R. S. Eachus presented a paper titled, "The Mechanism of $Ir^{3+}$ Sensitization of Silver Halide Materials".

B. H. Carroll, "Iridium Sensitization: A Literature Review", *Photographic Science and Engineering,* vol. 24, No. 6, Nov./Dec. 1980, pp. 265–267.

McDugle et al., U.S. Ser. No. 179,376, filed Apr. 8, 1988, commonly assigned, titled Photographic Emulsion Containing Internally Modified Silver Halide Grains.

Keevert et al., U.S. Ser. No. 179,377, filed Apr. 8, 1988, commonly assigned, titled Photographic Emulsions Containing Internally Modified Silver Halide Grains.

Marchetti et al., U.S. Ser. No. 179,378, filed Apr. 8, 1988, commonly assigned, titled Photographic Emulsions Containing Internally Modified Silver Halide Grains.

*Primary Examiner*—Paul R. Michl
*Assistant Examiner*—Hoa Van Le
*Attorney, Agent, or Firm*—Carl O. Thomas

[57] ABSTRACT

Photographic silver halide emulsions are disclosed comprised of radiation sensitive silver halide grains exhibiting a face centered cubic crystal lattice structure internally containing oxo coordination ligands and a transition metal chosen from groups 6, 7, and 8 of the periodic table of elements.

15 Claims, 1 Drawing Sheet

PHOTOGRAPHIC EMULSIONS CONTAINING INTERNALLY MODIFIED SILVER HALIDE GRAINS

FIELD OF THE INVENTION

The invention relates to photography. More specifically, the invention relates to photographic silver halide emulsions and to photographic elements containing these emulsions.

DEFINITION OF TERMS

All references to periods and groups within the periodic table of elements are based on the format of the periodic table adopted by the American Chemical Society and published in the *Chemical and Engineering News*, Feb. 4, 1985, p. 26. In this form the prior numbering of the periods was retained, but the Roman numeral numbering of groups and designations of A and B groups (having opposite meanings in the U.S. and Europe) was replaced by a simple left to right 1 through 18 numbering of the groups.

The term "dopant" refers to a material other than a silver or halide ion contained within a silver halide grain.

The term "transition metal" refers to any element of groups 3 to 12 inclusive of the periodic table of elements.

The term "heavy transition metal" refers to transition metals of periods 5 and 6 of the periodic table of elements.

The term "light transition metal" refers to transition metals of period 4 of the periodic table of elements.

The term "palladium triad transition metals" refers to period 5 elements in groups 8 to 10 inclusive—i.e., ruthenium, rhodium, and palladium.

The term "platinum triad transition metals" refers to period 6 elements in groups 8 to 10 inclusive—i.e., osmium, iridium, and platinum.

The term "$pK_{sp}$" indicates the negative logarithm of the solubility product constant of a compound.

Grain sizes, unless otherwise indicated, are mean effective circular diameters of the grains, where the effective circular diameter is the diameter of a circle having an area equal to the projected area of the grain.

Photographic speeds are reported as relative speeds, except as otherwise indicated.

PRIOR ART

Trivelli and Smith U.S. Pat. No. 2,448,060, issued Aug. 31, 1948, taught that silver halide emulsions can be sensitized by adding to the emulsion at any stage of preparation—i.e., before or during precipitation of the silver halide grains, before or during the first digestion (physical ripening), before or during the second digestion (chemical ripening), or just before coating, a compound of a palladium or platinum triad transition metal, identified by the general formula:

$$R_2MX_6$$

wherein

R represents a hydrogen, an alkali metal, or an ammonium radical,

M represents a palladium or platinum triad transition metal, and

X represents a halogen atom—e.g., chlorine or bromine.

The formula compounds are hexacoordinated heavy transition metal complexes which are water soluble. When dissolved in water $R_2$ dissociates as two cations while the transition metal and halogen ligands disperse as a hexacoordinated anionic complex.

With further investigation the art has recognized a distinct difference in the photographic effect of transition metal compounds in silver halide emulsions, depending upon whether the compound is introduced into the emulsion during precipitation of silver halide grains or subsequently in the emulsion making process. In the former instance it has been generally accepted that the transition metal can enter the silver halide grain as a dopant and therefore be effective to modify photographic properties, though present in very small concentrations. When transition metal compounds are introduced into an emulsion after silver halide grain precipitation is complete, the transition metals can be absorbed to the grain surfaces, but are sometimes largely precluded from grain contact by peptizer interactions. Orders of magnitude higher concentrations of transition metals are required to show threshold photographic effects when added following silver halide grain formation as compared to transition metals incorporated in silver halide grains as dopants. The art distinction between metal doping, resulting from transition metal compound addition during silver halide grain formation, and transition metal sensitizers, resulting from transition metal compound addition following silver halide grain formation, is illustrated by *Research Disclosure*, Vol. 176, Dec. 1978, Item 17643, wherein Section IA, dealing with metal sensitizers introduced during grain precipitation, and Section IIIA, dealing with metal sensitizers introduced during chemical sensitization, provide entirely different, lists of prior art teachings relevant to each practice. *Research Disclosure* is published by Kenneth Mason Publications, Ltd., Emsworth, Hampshire P010 7DD, England.

Since transition metal dopants can be detected in exceedingly small concentrations in silver halide grains and since usually the remaining elements in the transition metal compounds introduced during grain precipitation are much less susceptible to detection (e.g., halide or aquo ligands or halide ions), grain analysis has focused on locating and quantifying the transition metal dopant concentration in the grain structure. While Trivelli and Smith taught to employ only anionic hexacoordinated halide complexes of transition metals, many if not most listings of transition metal compounds to be introduced during silver halide grain formation have indiscriminately lumped together simple salts of transition metals and transition metal complexes. This is evidence that the possibility of ligand inclusion in grain formation or any modification in performance attributable thereto was overlooked.

In fact, a survey of the photographic literature identifies very few teachings of adding to silver halide emulsions during grain formation compounds of transition metals in which the transition metal is other than a palladium and platinum triad transition metal and the remainder of the compound is provided by other than halide ligands, halide and aquo ligands, halides which dissociate to form anions in solution, or ammonium or alkali metal moieties that dissociate to form cations in solution. The following is a listing of the few variant teachings that have been identified:

Shiba et al U.S. Pat. No. 3,790,390 discloses preparing a blue responsive silver halide emulsion suitable for flash exposure which can be handled under bright yellowish-green light. The emulsion contains grains with a mean size no larger than 0.9 μm, at least one group 8–10 metal compound, and a formula specified merocyanine dye. Examples of transition metal compounds are simple salts of light transition metals, such as iron, cobalt, and nickel salts, and hexacoordinated complexes of light transition metals containing cyanide ligands. Heavy transition metal compounds are disclosed only as the usual simple salts or hexacoordinated complexes containing only halide ligands. Palladium (II) nitrate, a simple salt, is also disclosed as well as palladium tetrathiocyanatopalladate (II), a tetracoordinated complex of palladium.

Ohkubo et al U.S. Pat. No. 3,890,154 and Habu et al U.S. Pat. No. 4,147,542 are similar to Shiba et al, differing principally in employing different sensitizing dyes to allow recording of green flash exposures.

Sakai et al U.S. Pat. No. 4,126,472 discloses producing a high contrast emulsion suitable for lith photography by ripening an emulsion containing at least 60 mole percent silver chloride in the presence of $10^{-6}$ to $10^{-4}$ mole per mole of silver halide of a water soluble iridium salt and further adding a hydroxytetraazaindene and a polyoxyethylene compound. In addition to the usual iridium halide salts and hexacoordinated iridium complexes containing halide ligands Sakai et al discloses cationic hexacoordinated complexes of iridium containing amine ligands. Since iridium is introduced after silver halide precipitation is terminated, the iridium is not employed as a grain dopant, but as a grain surface modifier. This undoubtedly accounts for the variance from conventional iridium compounds used for doping.

D. M. Samoilovich, "The Influence of Rhodium and Other Polyvalent Ions on the Photographic Properties of Silver Halide Emulsions", in a paper presented to 1978 International Congress of Photographic Science, Rochester Institute of Technology, Aug. 20–26, 1978, reported investigations of chloride iridium, rhodium, and gold complexes and, in addition, an emulsion prepared by introducing $(NH_4)_6Mo_7O_{24}4H_2O$. The latter dissociates in water to form a molybdenum cluster having a net negative charge of −6. Neither the +6 oxidation state ascribed to molybdenum nor the −6 valence of the anionic cluster should be confused with a hexacoordinated complex of a single transition metal atom.

At the 1982 International Congress of Photographic Science at the University of Cambridge, R. S. Eachus presented a paper titled, "The Mechanism of $Ir^{3+}$ Sensitization of Silver Halide Materials", wherein inferential electron paramagnetic resonance (EPR) spectroscopic evidence was presented that $Ir^{3+}$ ions were incorporated into melt-grown silver bromide and silver chloride crystals as $(IrBr_6)^{-3}$ and $(IrCl_6)^{-3}$. In emulsions and sols of these salts, the hexabromoiridate and hexachloroiridate molecular ions, as well as similar complexes containing mixed halides, were introduced during precipitation. The aquated species $[IrCl_4(H_2O)_2]^{-1}$ and $[IrCl_5(H_2O)]^{-2}$ were also successfully doped into precipitates of both silver salts. Eachus went on to speculate on various mechanisms by which incorporated iridium ions might contribute to photogenerated free electron and hole management, including latent image formation.

Greskowiak published European Patent Application No. 0,242,190/A2 discloses reductions in high intensity reciprocity failure in silver halide emulsions formed in the presence of one or more complex compounds of rhodium (III) having 3, 4, 5, or 6 cyanide ligands attached to each rhodium ion.

Janusonis et al, U.S. Pat. No. 4,835,093 discloses incorporating either rhenium ions or rhenium hexacoordination complexes into silver halide grains. Rhenium hexacoordination complex ligands disclosed are halide, nitrosyl, thionitrosyl, cyanide, aquo, cyanates (i.e., cyanate, thiocyanate, selenocyanate, and tellurocyanate), and azide ligands. Varied photographic effects are disclosed, depending on halide content, the surface sensitization or fogging of the grains, and the level of rhenium doping.

RELATED PATENT APPLICATIONS

McDugle et al U.S. Ser. No. 179,376, filed Apr. 8, 1988, commonly assigned, titled PHOTOGRAPHIC EMULSION CONTAINING INTERNALLY MODIFIED SILVER HALIDE GRAINS, discloses silver halide emulsions comprised of radiation sensitive silver halide grains exhibiting a face centered cubic crystal lattice structure internally containing a nitrosyl or thionitrosyl coordination ligand and a transition metal chosen from groups 5 to 10 inclusive of the periodic table of elements.

Keevert et al U.S. Ser. No. 179,377, filed Apr. 8, 1988, commonly assigned, titled PHOTOGRAPHIC EMULSIONS CONTAINING INTERNALLY MODIFIED SILVER HALIDE GRAINS, discloses photographic emulsions comprised of radiation sensitive silver halide grains containing greater than 50 mole percent chloride and less than 5 mole percent iodide, based on total silver, with any residual halide being bromide. The grains exhibit a face centered cubic crystal structure formed in the presence of a hexacoordination complex of rhenium, ruthenium, or osmium with at least four cyanide ligands. The emulsions exhibit increased sensitivity.

Marchetti et al U.S. Ser. No. 179,378, filed Apr. 8, 1988, commonly assigned, titled PHOTOGRAPHIC EMULSIONS CONTAINING INTERNALLY MODIFIED SILVER HALIDE GRAINS, discloses photographic emulsions comprised of radiation sensitive silver bromide or bromoiodide grains which exhibit a face centered cubic crystal structure formed in the presence of a hexacoordination complex of rhenium, ruthenium, or osmium with at least four cyanide ligands. The emulsions exhibit increased stability. Also, reductions in low intensity reciprocity failure are observed in these emulsions.

SUMMARY OF THE INVENTION

In one aspect this invention is directed to a photographic silver halide emulsion comprised of radiation sensitive silver halide grains exhibiting a face centered cubic crystal lattice structure internally containing a hexacoordination complex that satisfies the formula:

$$[M(O)_2L_4]^n \quad (I)$$

where

M is a heavy transition metal selected from groups 6, 7, and 8 of the periodic table of elements;

L is a bridging ligand; and n is −2 or −3.

Silver halide photography serves a wide spectrum of imaging needs. The amateur 35 mm photographer expects to capture images reliably over the full range of shutter speeds his or her camera offers, typically ranging from 1/10 of second or longer to 1/1000 of a second or less, under lighting conditions ranging from the most marginal twilight to mid-day beach and ski settings, with pictures being taken in a single day or over a period of months and developed immediately or months after taking, with the loaded camera often being left in an automobile in direct sun and stifling heat in the summer or overnight in mid-winter. These are stringent demands to place on the complex chemical system which the film represents. Parameters such as speed, contrast, fog, pressure sensitivity, high and low intensity reciprocity failures, and latent image keeping are all important in achieving acceptable photographic performance.

While specialized and professional photography seldom places such diverse demands on a single film as the amateur photographer, even more stringent performance criteria are routinely encountered that must be invariantly satisfied. Action and motion study photography requires extremely high photographic speeds. High shutter speeds often require high intensity exposures. For such applications high intensity reciprocity failure must be avoided. Astronomical photography also requires high levels of photographic sensitivity, but exposure times can extend for hours to capture light from faint celestial objects. For such applications low intensity reciprocity failure is to be avoided. For medical radiography high photographic speeds are required and resistance to localized pressure modification of sensitivity (e.g., kink desensitization) is particularly important in larger formats. Portrait photography requires a choice of contrasts, ranging from low to moderately high, to obtain the desired viewer response. Graphic arts photography requires extremely high levels of contrast. In some instances speed reduction (partial desensitization) is desired to permit handling of the film under less visually fatiguing lighting conditions (e.g., room light and/or green or yellow light) than customary red safe lighting. Color photography requires careful matching of the blue, green, and red photographic records, over the entire useful life of a film. While most silver halide photographic materials produce negative images, positive images are required for many applications. Both direct positive imaging and positive imaging of negative-working photographic materials by reversal processing serve significant photographic needs.

In attempting to tailor the properties of silver halide photographic materials to satisfy specific imaging requirements, there has emerged a general recognition of the utility of transition metal dopants in radiation-sensitive silver halide grains. Progress in modifying emulsion properties by transition metal doping has, however, reached a plateau, since there are only a limited number of transition metals as well as a limited number of possible transition metal concentrations and placements within the grain.

The present invention is based on the recognition that the transition metal complexes of complexes of formula I serve as a useful means for modifying and improving photographic performance when occluded within the face centered cubic crystal structure of radiation-sensitive silver halide grains. In a specific, demonstrated application, the complexes of formula I have been shown to be capable of trapping electrons within the silver halide grains.

When a photon is captured within a silver halide grain, it generates a hole-electron pair. In simple, negative-working emulsions the photogenerated electrons are predominantly captured at the grain surface, since surface crystal defects provide electron trapping sites. Surface electron trapping leads directly to surface latent image formation, permitting the grains to be developed in a surface developer (a developer lacking ingredients, such as iodide or solvents, capable of allowing developing agent access to the grain interior). In many instances photographic advantages can be realized by shifting the balance of electron trapping away from the grain surface to the interior of the grains. For example, surface fogged direct positive emulsions, which rely on the photogenerated holes to bleach fog from grain surfaces during exposure, are notably improved by internally trapping photogenerated electrons. In other emulsions, most notably direct positive emulsions of the internal image desensitization type, such as emulsions of the type disclosed by Evans U.S. Pat. Nos. 3,761,276 and 3,923,513 and Evans et al U.S. Pat. No. 4,504,570, doping to achieve internal electron trapping is used to balance surface and internal sensitivities for maximum photographic speed. It is also recognized that internal electron trapping to form an internal latent image can produce superior negative-working emulsions—e.g., emulsions having superior spectral sensitivity, such as those disclosed by Gilman et al U.S. Pat. No. 3,979,213.

DESCRIPTION OF PREFERRED EMBODIMENTS

Figure 1:
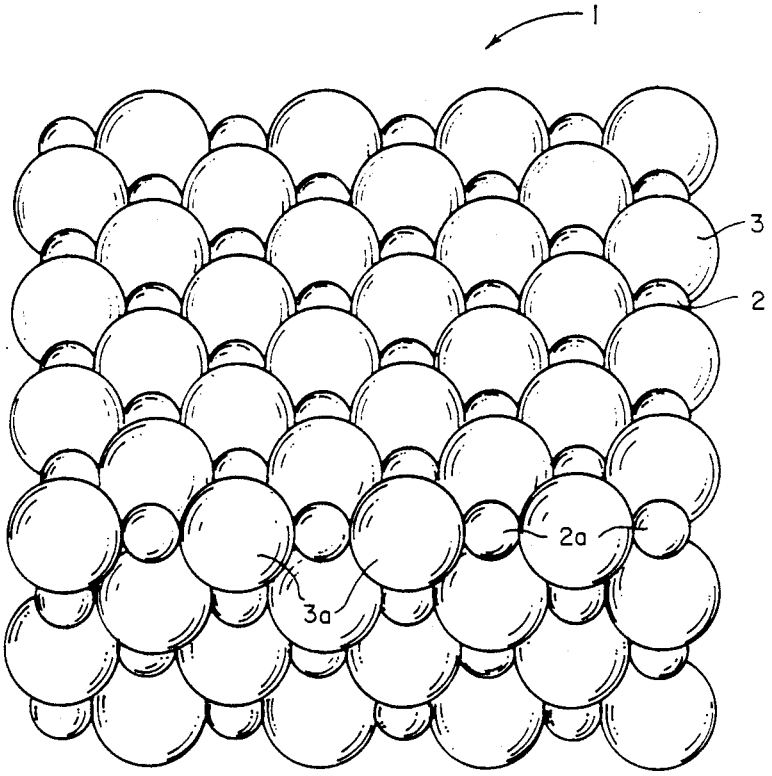
FIG. 1 is a schematic view of a silver bromide crystal structure with the upper layer of ions lying along a {100} crystallographic face.

Unlike silver iodide, which commonly forms only $\beta$ and $\gamma$ phases, each of silver chloride and silver bromide form a face centered cubic crystal lattice structure of the rock salt type. In FIG. 1 four lattice planes of a crystal structure 1 of silver ions 2 and bromide ions 3 is shown, where the upper layer of ions lies in a {100} crystallographic plane. The four rows of ions shown counting from the bottom of FIG. 1 lie in a {100} crystallographic plane which perpendicularly intersects the {100} crystallographic plane occupied by the upper layer of ions. The row containing silver ions **2*a* and bromide ions 3*a*** lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The arrangement of ions in a silver chloride crystal is the same as that shown in FIG. 1, except that chloride ions are smaller than bromide ions. Silver halide grains in photographic emulsions can be formed of bromide ions as the sole halide, chloride ions as the sole halide, or any mixture of the two. It is also common practice to incorporate minor amounts of iodide ions in photographic silver halide grains. Since chlorine, bromine, and iodine are 3rd, 4th, and 5th period elements, respectively, the iodide ions are larger than the bromide ions. As much as 40 mole percent of the total halide in a silver bromide cubic crystal lattice structure can be accounted for by iodide ions before silver iodide separates as a separate phase. In photographic emulsions iodide concentrations in silver halide grains seldom exceeds 20 mole percent and is typically less than 10 mole percent, based on silver. However, specific applications differ widely in their use of iodide. Silver bromoiodide emulsions are employed in high speed (ASA 100 or greater) camera films, since the presence of iodide allows higher speeds to be realized at any given level of granularity. Silver bromide emulsions or silver bromoiodide emulsions containing less than 5 mole percent iodide are customarily employed for radiography. Emulsions employed for graphic arts and color paper typically contain greater than 50 mole percent, preferably greater than 70 mole percent, and optimally greater than 85 mole percent, chloride, but less than 5 mole percent, preferably less than 2 mole percent, iodide, any balance of the halide not accounted for by chloride or iodide being bromide.

The present invention is concerned with photographic silver halide emulsions in which a transition metal complex has been internally introduced into the cubic crystal structure of the grain. The parameters of such an incorporated complex can be roughly appreciated by considering the characteristics of a single silver ion and six adjacent halide ions (hereinafter collectively referred to as the seven vacancy ions of $[AgX_6]^{-5}$ where X represents halogen) that must be omitted from the crystal structure to accommodate spatially a hexacoordinated transition metal complex. The seven vacancy ions exhibit a net charge of $-5$. This suggests that anionic transition metal complexes should be more readily incorporated in the crystal structure than neutral or cationic transition metal complexes. This also suggests that the capability of a hexacoordinated transition metal complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare elements and that their hole or electron trapping capability is entirely a function of their oxidation state.

Referring to FIG. 1, it should be further noted that the silver ions are much smaller than the bromide ions, though silver lies in the 5th period while bromine lies in the 4th period. Further, the lattice is known to accommodate iodide ions, which are still larger than bromide ions. This suggests that the size of 5th and 6th period transition metals should not in itself provide any barrier to their incorporation. A final observation that can be drawn from the seven vacancy ions is that the six halide ions exhibit an ionic attraction not only to the single silver ion that forms the center of the vacancy ion group, but are also attracted to other adjacent silver ions.

The present invention employs within silver halide grains transition metal hexacoordination complexes containing a central heavy transition metal ion and coordinated ligands satisfying formula I above. These coordination complexes each take the place of a silver ion with the six coordination ligands taking the place of six halide ions next adjacent to the displaced silver ion.

To appreciate that a coordination complex of a transition metal having ligands other than halide ligands or, as recognized by Eachus, cited above, aquo ligands, can be accommodated into silver halide cubic crystal lattice structure it is necessary to consider that the attraction between the transition metal and its ligands may not be entirely ionic, but to at least some extent the result of covalent bonding, the latter being much stronger than the former. Since the size of a hexacoordinated complex is determined not only by the size of the atoms forming the complex, but also by the strength of the bonds between the atoms, a coordination complex can be spatially accommodated into a silver halide crystal structure in the space that would otherwise be occupied by the vacancy ions, even though the number and/or diameters of the individual atoms forming the complex exceeds that of the vacancy ions. This is because the covalent bond strength can significantly reduce bond distances and therefore the size of the entire complex. It is a specific recognition of this invention that multielement ligands of transition metal coordination complexes can be spatially accommodated to single halide ion vacancies within the crystal structure.

While spatial compatibility is important in choosing suitable transition metal coordination complexes, another factor which must be taken into account is the compatibility of the complex with the next adjacent ions in the crystal lattice structure. It is the recognition of this invention that compatibility can be realized by choosing bridging ligands for the transition metal complex. Looking at a single row of silver and halide ions in a cubic crystal lattice structure, the following relationship can be observed:

$$Ag^+ X^- Ag^+ X^- Ag^+ X^- Ag^+ X^-, \text{etc.}$$

Notice that the halide ions X are attracting both adjacent silver ions in the row. When the portion of a transition metal coordination complex lying in a single row of silver and halide ions in a crystal structure is considered, the following relationship can be observed:

$$Ag^+ X^- Ag^+ —L—M—L— Ag^+ X^-, \text{etc.}$$

where

M represents a transistion metal and

L represents a bridging ligand.

While only one row of silver and halide ions is shown, it is appreciated that the complex forms part of three identical perpendicular rows of silver and halide ions having the transition metal M as their point of intersection.

By considering the crystal structure of silver halide it is apparent that the art has in all probability been fully justified in employing simple transition metal halide salts and hexacoordinated transition metal complexes containing only halide ligands interchangeably to obtain identical photographic effects. Not only has the art failed to recognize any advantage or modification in photographic properties attributable to halide ion inclusion, it has also failed to observe any photographic property modification attributable to aquo ligand inclusion. On this latter point, it should be noted that silver halide grains are routinely precipitated in aqueous media containing halide ions, raising significant doubts about whether any grain structure modification was achieved by the substitution of one or two aquo ligands for halide ligands in hexacoordinate metal transition complexes. There are two possible explanations, either aquo ligands may exchange with halide ions prior to or during precipitation or aquo occlusions may be more common than generally appreciated.

The present invention runs counter to the accepted teachings of the art. The art has conducted extensive experimental investigation in the 40 years following the discoveries of Trivelli and Smith, cited above, and reported that similar photographic performance is realized whether transition metals are internally introduced into silver halide grains by addition to the precipitation medium as simple salts, haloligand transition complexes, or comparable halo complexes having one or more of the halo ligands displaced by aquo ligands.

The essential contribution which this invention makes to the art is the recognition that transition metal coordination complexes containing oxygen ligands can play a significant role in modifying photographic performance. The transition metals known to form complexes with oxygen ligands are the heavy transition metals of groups 6, 7, and 8 of the periodic table of elements. Since technetium is unstable and therefore for all practical purposes unavailable, the metals capable of forming hexacoordination complexes containing oxygen ligands are molybdenum, ruthenium, tungsten, rhenium, and osmium. A pair of oxygen atoms form ligands of each heavy transition metal atom. The four remaining ligands completing each hexacoordination complex can be any convenient choice of bridging ligands.

Bridging ligands are those which can serve as bridging groups between two or more metal centers. Bridging ligands can be either monodentate or ambidentate. A monodentate bridging ligand has only one ligand atom that forms two (or more) bonds to two (or more) different metal atoms. For monoatomic ligands, such as halides, and for ligands containing only one possible donor atom, the monodentate form of bridging is the only possible one. Multielement ligands with more than one donor atom can also function in a bridging capacity and are referred to as ambidentate ligands.

Specific examples of preferred bridging ligands include halide ligands (specifically, fluoride, chloride, bromide, and iodide); cyanide ligands; ligands that are cyanates-i.e, cyanate, thiocyanate, selenocyanate, and tellurocyanate ligands; and azide ligands. Still other bridging ligand choices are possible.

The transition metal coordination complexes contemplated for grain incorporation exhibit a negative net ionic charge. One or more counter ions are therefore associated with the complex to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

Table I provides a listing of illustrative compounds of hexacoordinated heavy transition metal complexes satisfying the requirements of the invention:

TABLE I

| | |
|---|---|
| TMC-1 | $[Re(O)_2Cl_4]^{-3}$ |
| TMC-2 | $[Re(O)_2Br_4]^{-3}$ |
| TMC-3 | $[Re(O)_2I_4]^{-3}$ |
| TMC-4 | $[Re(O)_2(N_3)_4]^{-3}$ |
| TMC-5 | $[Re(O)_2(OCN)_4]^{-3}$ |
| TMC-6 | $[Re(O)_2(SCN)_4]^{-3}$ |
| TMC-7 | $[Re(O)_2(SeCN)_4]^{-3}$ |
| TMC-8 | $[Re(O)_2(TeCN)_4]^{-3}$ |
| TMC-9 | $[Re(O)_2(CN)_4]^{-3}$ |
| TMC-10 | $[Os(O)_2Cl_4]^{-2}$ |

TABLE I-continued

| | |
|---|---|
| TMC-11 | $[Os(O)_2Br_4]^{-2}$ |
| TMC-12 | $[Os(O)_2I_4]^{-2}$ |
| TMC-13 | $[Os(O)_2(N_3)_4]^{-2}$ |
| TMC-14 | $[Os(O)_2(OCN)_4]^{-2}$ |
| TMC-15 | $[Os(O)_2(SCN)_4]^{-2}$ |
| TMC-16 | $[Os(O)_2(SeCN)_4]^{-2}$ |
| TMC-17 | $[Os(O)_2(TeCN)_4]^{-2}$ |
| TMC-18 | $[Os(O)_2(CN)_4]^{-2}$ |
| TMC-19 | $[Ru(O)_2Cl_4]^{-2}$ |
| TMC-20 | $[Ru(O)_2Br_4]^{-2}$ |
| TMC-21 | $[Ru(O)_2I_4]^{-2}$ |
| TMC-22 | $[Ru(O)_2F_4]^{-2}$ |
| TMC-23 | $[Ru(O)_2(N_3)_4]^{-2}$ |
| TMC-24 | $[Ru(O)_2(OCN)_4]^{-2}$ |
| TMC-25 | $[Ru(O)_2(SCN)_4]^{-2}$ |
| TMC-26 | $[Ru(O)_2(SeCN)_4]^{-2}$ |
| TMC-27 | $[Ru(O)_2(TeCN)_4]^{-2}$ |
| TMC-28 | $[Ru(O)_2(CN)_4]^{-2}$ |
| TMC-29 | $[Mo(O)_2(Cl)_4]^{-2}$ |
| TMC-30 | $[Mo(O)_2(Br)_4]^{-2}$ |
| TMC-31 | $[Mo(O)_2(OCN)_4]^{-2}$ |
| TMC-32 | $[Mo(O)_2(SCN)_4]^{-2}$ |
| TMC-33 | $[Mo(O)_2(SeCN)_4]^{-2}$ |
| TMC-34 | $[Mo(O)_2(TeCN)_4]^{-2}$ |
| TMC-35 | $[Mo(O)_2(N_3)_4]^{-2}$ |
| TMC-36 | $[Mo(O)_2(CN)_4]^{-2}$ |
| TMC-37 | $[W(O)_2Cl_4]^{-3}$ |
| TMC-38 | $[W(O)_2Br_4]^{-3}$ |
| TMC-39 | $[W(O)_2I_4]^{-3}$ |
| TMC-40 | $[W(O)_2(N_3)_4]^{-3}$ |
| TMC-41 | $[W(O)_2(OCN)_4]^{-3}$ |
| TMC-42 | $[W(O)_2(SCN)_4]^{-3}$ |
| TMC-43 | $[W(O)_2(SeCN)_4]^{-3}$ |
| TMC-44 | $[W(O)_2(TeCN)_4]^{-3}$ |
| TMC-45 | $[W(O)_2(CN)_4]^{-3}$ |

Procedures for beginning with the compounds of Table I and preparing photographic silver halide emulsions benefitted by incorporation of the hexacoordinated transition metal complex can be readily appreciated by considering the prior teachings of the art relating to introducing transition metal dopants in silver halide grains. Such teachings are illustrated by Wark U.S. Pat. No. 2,717,833; Berriman U.S. Pat. No. 3,367,778; Burt U.S. Pat. No. 3,445,235; Bacon et al U.S. Pat. No. 3,446,927; Colt U.S. Pat. No. 3,418,122; Bacon U.S. Pat. No. 3,531,291; Bacon U.S. Pat. No. 3,574,625; Japanese Patent (Kokoku) No. 33781/74 (priority 10 May 1968); Japanese Patent (Kokoku) No. 30483/73 (priority 2 Nov. 1968); Ohkubo et al U.S. Pat. No. 3,890,154; Spence et al U.S. Pat. Nos. 3,687,676 abd 3,690,891; Gilman et al U.S. Pat. No. 3,979,213; Motter U.S. Pat. No. 3,703,584; Japanese Patent (Kokoku) No. 32738/70 (priority 22 Oct. 1970); Shiba et al U.S. Pat. No. 3,790,390; Yamasue et al U.S. Pat. No. 3,901,713; Nishina et al U.S. Pat. No. 3,847,621; *Research Disclosure*, Vol. 108, Apr. 1973, Item 10801; Sakai U.S. Pat. No. 4,126,472; Dostes et al Defensive Publication No. T962,004 and French Patent No. 2,296,204; U. K. Specification No. 1,527,435 (priority 17 Mar. 1975); Japanese Patent Publication (Kokai) No. 107,129/76 (priority 18 Mar. 1975); Habu et al U.S. Pat. Nos. 4,147,542 and 4,173,483; *Research Disclosure*, Vol. 134, June 1975, Item 13452; Japanese Patent Publication (Kokai) No. 65,432/77 (priority 26 Nov. 1975); Japanese Patent Publication (Kokai) No. 76,923/77 (priority 23 Dec. 1975); Japanese Patent Publication (Kokai) No. 88,340/77 (priority 26 Jan. 1976); Japanese Patent Publication (Kokai) No. 75,921/78 (priority 17 Dec. 1976); Okutsu et al U.S. Pat. No. 4,221,857; Japanese Patent Publication (Kokai) No. 96,024/79 (priority 11 Jan. 1978); *Research Disclosure*, Vol. 181, May 1979, Item 18155;

Kanisawa et al U.S. Pat. No. 4,288,533; Japanese Patent Publication (Kokai) No. 25,727/81 (priority 7 Aug. 1979); Japanese Patent Publication (Kokai) 51,733/81 (priority 2 Oct. 1979); Japanese Patent Publication (Kokai) No. 166,637/80 (priority 6 Dec. 1979); and Japanese Patent Publication (Kokai) 149,142/81 (priority 18 Apr. 1970); the disclosures of which are here incorporated by reference.

When silver halide grains are formed a soluble silver salt, usually silver nitrate, and one or more soluble halide salts, usually an ammonium or alkali metal halide salt, are brought together in an aqueous medium. Precipitation of silver halide is driven by the high $pK_{sp}$ of silver halides, ranging from 9.75 for silver chloride to 16.09 for silver iodide at room temperature. For a transition metal complex to coprecipitate with silver halide it is preferred that it form a high $pK_{sp}$ compound. If the $pK_{sp}$ is too low, precipitation may not occur. On the other hand, if the $pK_{sp}$ is too high, the compound may precipitate as a separate phase. Optimum $pK_{sp}$ values for silver or halide counter ion compounds of transition metal complexes should be in or near the range of $pK_{sp}$ values for photographic silver halides-that is, in the range of from about 8 to 20, preferably about 9 to 17. Since transition metal complexes having only halide ligands or only aquo and halide ligands are known to coprecipitate with silver halide, substitution of two oxo ligands is generally compatible with coprecipitation.

The transition metal complexes satisfying the requirements of the invention can be incorporated in silver halide grains in the same concentrations, expressed in moles per mole of silver, as have been conventionally employed for transition metal doping. An extremely wide range of concentrations has been taught, ranging from as low as $10^{-10}$ mole/Ag mole taught by Dostes et al, cited above, for reducing low intensity reciprocity failure and kink desensitization in negative-working emulsions, to concentrations as high as $10^{-3}$ mole/Ag mole, taught by Spencer et al, cited above, for avoidance of dye desensitization. While useful concentrations can vary widely, depending upon the halide content of the grains, the transition metal selected, its oxidation state, the specific ligands incorporated, and the photographic effect sought, concentrations of less than $10^{-6}$ mole/Ag mole are contemplated for improving the preformance of surface latent image forming emulsions without surface desensitization. Concentrations of from $10^{-9}$ to $10^{-6}$ have been widely suggested. Graphic arts emulsions seeking to employ transition metals to increase contrast with incidental or even intentionally sought speed loss often range somewhat higher in transition metal dopant concentrations than other negative working emulsions, with concentrations of up to $10^{-4}$ mole/Ag mole being common. For internal electron trapping, as is commonly sought in direct positive emulsions, concentrations in the range of from $10^{-6}$ to $10^{-4}$ mole/Ag mole are preferred, with optimal concentrations being in the range of from $1\times10^{-5}$ to $5\times10^{-5}$ mole/Ag mole.

Apart from the incorporated transition metal coordination complexes satisfying the requirements of the invention the silver halide grains, the emulsions of which they form a part, and the photographic elements in which they are incorporated can take any of a wide variety of conventional forms. A survey of these conventional features as well as a listing of the patents and publications particularly relevant to each teaching is provided by *Research Disclosure*, Item 17643, cited above, the disclosure of which is here incorporated by reference. It is specifically contemplated to incorporate transition metal coordination complexes satisfying the requirements of this invention in tabular grain emulsions, particularly thin (less than 0.2 μm) and/or high aspect ratio (>8:1) tabular grain emulsions, such as those disclosed in Wilgus et al U.S. Pat. No. 4,434,226; Kofron et al U.S. Pat. No. 4,439,520; Daubendiek et al U.S. Pat. Nos. 4,414,310, 4,693,964. and 4,672,027; Abbott et al U.S. Pat. Nos. 4,425,425 and 4,425,426; Wey U.S. Pat. No. 4,399,215; Solberg et al U.S. Pat. No. 4,433,048; Dickerson U.S. Pat. No. 4,414,304; Mignot U.S. Pat. No. 4,386,156; Jones et al U.S. Pat. No. 4,478,929; Evans et al U.S. Pat. No. 4,504,570; Maskasky U.S. Pat. Nos. 4,400,463, 4,435,501, 4,643,966, 4,684,607, 4,713,320, and 4,713,323; Wey et al U.S. Pat. No. 4,414,306; and Sowinski et al U.S. Pat. No. 4,656,122; the disclosures of which are here incorporated by reference.

EXAMPLES

The invention can be better appreciated by reference to the following specific examples:

Example 1

| Emulsion 1U (a control emulsion) | |
|---|---|
| Six solutions were prepared as follows: | |
| Solution 1(1) | |
| Gelatin (bone) | 50 g |
| D.W.* | 2000 mL |
| Solution 2(1) | |
| Sodium bromide | 10 g |
| D.W. | 100 mL |
| Solution 3(1) | |
| Sodium bromide | 412 g |
| D.W. to total volume | 1600 mL |
| Solution 4(1) | |
| Silver nitrate (5 Molar) | 800 mL |
| D.W. to total volume | 1600 mL |
| Solution 5(1) | |
| Gelatin (phthalated) | 50 g |
| D.W. | 300 mL |
| Solution 6(1) | |
| Gelatin (bone) | 130 mL |
| D.W. | 400 mL |

*distilled water

Solution 1(1) was adjusted to a pH of 3.0 with nitric acid at 40° C. The temperature of Solution 1(1) was adjusted to 70° C. Solution 1(1) was the adjusted to a pAg of 8.2 with Solution 2(1). Solutions 3(1) and 4(1) were simultaneously run into the adjusted Solution 1(1) at a constant rate for the first 4 minutes with introduction being accelerated for the next 40 minutes. The addition rate was held constant over a final 2 minute period for a total addition time of 46 minutes. The pAg was maintained at 8.2 over the entire run. After the concurrent addition of Solutions 3(1) and 4(1), the temperature was adjusted to 40° C., the pH was adjusted to 4.5, and Solution 5(1) was added. The mixture was then held for 5 minutes, after which the pH was adjusted to 3.0 and the gel was allowed to settle. At the same time the temperature was dropped to 15° C. before decanting the liquid layer. The depleted volume was restored with distilled water. The pH was readjusted to 4.5, and the mixture was held at 40° C. for ½ hour before the pH was adjusted to 3.0 and the settling and decanting steps were repeated. Solution 6(1) was added, and the pH and pAg were adjust to 5.6 and 8.2, respectively.

Emulsion 1D (an example emulsion)

Example Emulsion 1D was prepared similarly as Control Emulsion 1U, except that the rhenium oxygen ligand hexacoordination complex TMC-9 was added in the amount of 25 micromoles per silver mole (final silver content) in the time period extending from the first 5 minutes of silver salt addition until 75% of the silver had been introduced into the reaction vessel.

PHOTOGRAPHIC COMPARISON

Emulsions 1U and 1D were examined undigested. Coatings were made at 27 mg Ag/dm$^2$ and 86 mg gelatin/dm$^2$. The coatings were exposed for 0.1 second to 365 nm radiation on a standard sensitometer. To investigate the ability of the emulsions to internally trap electrons, exposed coatings were bleached in a ferric ion solution for 5 minutes to remove surface development sites and then developed for 6 minutes in a hydroquinone-N-methyl-p-aminophenol hemisulfate surface developer SD-1 to which 0.5 g/L of potassium iodide had been added to the convert the developer to an internal developer.

The results are summarized in Table II below. Although analysis indicated that less than 10 percent of the rhenium oxygen ligand hexacoordination complex had actually been incorporated in the grain structure of the emulsion, the presence of the rhenium oxygen ligand complex dramatically increased the internal speed of the example emulsion 1D as compared to that of the undoped control emulsion 1U, indicating efficient internal trapping of photogenerated electrons.

Example 2

Emulsion 2U (a control emulsion)

Emulsion 2U was prepared identically as Emulsion 1U.

Emulsion 2D (an example emulsion)

Emulsion 2D was prepared identically as Emulsion 1D, except that the osmium oxygen ligand hexacoordination complex TMC-18 was substituted for TMC-9.

PHOTOGRAPHIC COMPARISON

The same photographic comparison was undertaken as in Example 1. The results are summarized in Table II below. Analysis indicated that 29 percent of the osmium oxygen ligand hexacoordination complex TMC-18 was incorporated in the grain structure. The presence of the osmium oxygen ligand complex dramatically increased the internal speed of the example emulsion 2D as compared to that of the undoped control emulsion 2U, indicating efficient internal trapping of photogenerated electrons.

TABLE II

| Emulsion | Transition Metal Complex Formula | Transition Metal Complex Micromole/Ag Mole | Internal Speed* |
|---|---|---|---|
| 1U | — | — | 3 |
| 2U | — | — | 3 |
| 1D | $K_3Re(O)_2(CN)_4$ | 25 | 100 |
| 2D | $K_2Os(O)_2(CN)_4$ | 25 | 100 |

*Measured at a density of 0.1 above fog

Example 2

Emulsion 3U (a control emulsion)

At 55° C., 90 g of gelatin were added to a reaction vessel containing 4 liters of water. This solution was adjusted to a pH of 3.0. The pAg was adjusted to 7.35 with a 3.0 molar solution of NaCl. Concentrated aqueous silver nitrate was introduced into the vigorously stirred gelatin solution along with sufficient aqueous sodium chloride to maintain the stated pAg. Sufficient material was added to prepared 6 moles of approximately 0.3 μm mean edge length silver chloride cubic grains.

Emulsion 3D (an example emulsion)

The procedures described above in connection with Emulsion 3U was repeated, except that an aqueous solution containing the rhenium oxygen ligand hexacoordination complex TMC-9 was added to a concentration of 10 mg/final Ag mole, concurrently with silver addition, starting after 4 percent of the silver nitrate had been introduced and containing until 70 percent of the silver nitrate had been introduced. The mean grain size of the emulsion was not changed by the complex addition.

PHOTOGRAPHIC COMPARISON

The emulsions were compared similarly as Emulsions 1U, 1D, 2U, and 2D. In addition, coated and exposed samples were also developed without prior bleaching in a second hydroquinone-N-methyl-p-aminophenol hemisulfate surface developer to determine the surface sensitivities of the emulsions. Results are summarized in Table III below.

Although analysis indicated that less than 9 percent of the rhenium oxygen ligand coordination complex was incorporated in the silver chloride grains, internal speed and contrast were both significantly enhanced.

Example 4

Emulsion 4U (a control emulsion)

This emulsion was prepared similarly as Emulsion 3U, except that 150 mg of a thioether silver halide ripening agent of the type disclosed by McBride U.S. Pat. No. 3,271,157 were added to the reaction vessel prior to the start of precipitation. This had the effect of increasing the mean edge length of the cubic grains to 0.5 μm.

Emulsion 4D (an example emulsion)

This emulsion was prepared similarly as Emulsion 4U, except that an aqueous solution containing the osmium oxygen ligand hexacoordination complex TMC-18 was added to a concentration of 20 mg/final Ag mole, concurrently with silver addition, starting after 4 percent of the silver nitrate had been introduced and containing until 70 percent of the silver nitrate had been introduced. The mean grain size of the emulsion was not changed by the complex addition.

PHOTOGRAPHIC COMPARISON

The emulsions were compared similarly as Emulsions 3U and 3D. Results are summarized in Table III below. Although analysis indicated that less than 10 percent of the osmium oxygen ligand coordination complex was incorporated in the silver chloride grains, the internal speed and contrast of Emulsion 4D was significantly enhanced as compared to control emulsion 4U.

TABLE III

| Emulsion | Transition Metal Complex Formula | Micromole/ Ag Mole | Internal Speed* | Internal Contrast** |
|---|---|---|---|---|
| 3U | — | — | 8 | <0.5 |
| 4U | — | — | 100 | 0.5 |
| 3D | $K_3Re(O)_2(CN)_4$ | 24 | 78 | 2.0 |
| 4D | $K_2Os(O)_2(CN)_4$ | 50 | 151 | 2.0 |

*Measured at a density of 0.1 above fog
**Measured over a density range of from 0.2 to a density corresponding to a 0.3 log E greater exposure The invention has been described in detail with particular reference to preferred embodiments thereof, but it will be understood that variations and modifications can be effected within the spirit and scope of the invention.

What is claimed is:

1. A photographic silver halide emulsion comprised of radiation sensitive silver halide grains exhibiting a face centered cubic crystal lattice structure internally containing a hexacoordination complex that satisfies the formula:

$$[M(O)_2L_4]^n$$

where

M is a heavy transition metal selected from groups 6, 7, and 8 of the periodic table of elements;

L is a bridging ligand; and n is −2 or −3.

2. A photographic silver halide emulsion according to claim 1 further characterized in that the halide forming the grains is comprised of bromide.

3. A photographic silver halide emulsion according to claim 2 further characterized in that the halide is additionally comprised of up to 40 mole percent iodide, based on total silver.

4. A photographic silver halide emulsion according to claim 1 further characterized in that the halide forming the grains is comprised of chloride.

5. A photographic silver halide emulsion according to claim 4 further characterized in that the halide forming the grains is at least 50 mole percent chloride and less than 5 mole percent iodide with any remaining halide being bromide.

6. A photographic silver halide emulsion according to claim 1 further characterized in that the hexacoordination complex is present in an amount sufficient to trap photogenerated electrons.

7. A photographic silver halide emulsion according to claim 6 further characterized in that the hexacoordination complex is present in a concentration ranging from $1\times10^{-6}$ to $1\times10^{-4}$ mole per silver mole.

8. A photographic silver halide emulsion according to claim 7 further characterized in that the hexacoordination complex is present in a concentration ranging from $1\times10^{-5}$ to $5\times10^{-5}$ mole per silver mole.

9. A photographic silver halide emulsion according to claim 1 further characterized in that L is chosen from the group consisting of halide, cyanide, cyanates, and azide ligands.

10. A photographic silver halide emulsion according to claim 1 further characterized in that M is a sixth period transition metal.

11. A photographic silver halide emulsion according to claim 10 further characterized in that M is rhenium.

12. A photographic silver halide emulsion according to claim 11 further characterized in that the hexacoordination complex satisfies the formula:

$$[Re(O)_2L_4]^{-3}$$

where L is chosen from among halogen and cyanide ligands.

13. A photographic silver halide emulsion according to claim 10 further characterized in that M is osmium.

14. A photographic silver halide emulsion according to claim 12 further characterized in that the hexacoordination complex satisfies the formula:

$$[Os(O)_2L_4]^{-2}$$

where L is chosen from among halogen and cyanide ligands.

15. A photographic silver halide emulsion according to claim 6 further characterized in that the silver halide grains are surface fogged.

* * * * *